US005379739A

United States Patent [19]

Dombrowski

[11] Patent Number: 5,379,739

[45] Date of Patent: Jan. 10, 1995

[54] CARBURETOR

[76] Inventor: Augustin Dombrowski, 5280 Paisley St., Montreal, Que., Canada, H1S 1V2

[21] Appl. No.: 765,193

[22] Filed: Sep. 25, 1991

[51] Int. Cl.[6] ..... F02M 19/03

[52] U.S. Cl. ..... 123/438; 261/41.1; 261/DIG. 39

[58] Field of Search ..... 261/DIG. 39, 41.1, 41.5; 123/438

[56] References Cited

U.S. PATENT DOCUMENTS

| | | | |
|---|---|---|---|
| 1,733,730 | 10/1929 | Haling | 261/41.5 |
| 2,589,536 | 3/1952 | Carbonaro | 261/DIG. 39 |
| 2,899,184 | 8/1959 | Olson | 261/41.1 |
| 4,632,788 | 12/1986 | Jones | 261/DIG. 39 |

FOREIGN PATENT DOCUMENTS

| | | | |
|---|---|---|---|
| 364883 | 1/1932 | United Kingdom | 261/41.5 |

*Primary Examiner*—Andrew M. Dolinar
*Attorney, Agent, or Firm*—Eric Fincham

[57] ABSTRACT

There is provided a carburetor having a main air passageway extending between an air inlet and an air outlet and having a narrower venturi portion intermediate the air inlet and air outlet, a throttle valve being located near the air outlet, and a second narrower passageway extending substantially parallel to the main air passageway, the second narrower passageway having an air inlet from the main air passageway, a fuel inlet to the second passageway downstream from the inlet, and a first outlet from the second passageway to the main air passageway proximate the venturi portion and a second outlet from the second passageway intermediate the venturi portion and a throttle valve, the main air passageway having a flange extending inwardly from said wall at a downstream end of the venturi portion. The carburetor provides better fuel economy and efficiency.

2 Claims, 1 Drawing Sheet

CARBURETOR

BACKGROUND OF THE INVENTION

The present invention relates to a carburetor and more particularly relates to improvements in carburetors for internal combustion engines.

Float type carburetors used in internal combustions are well known in the art. Such, carburetors are well known and have a fuel bowl which feeds the fuel to the engine through a venturi arrangement. While such arrangements are well known, it is desirable to have a carburetor which is simple and inexpensive to manufacture.

SUMMARY OF THE INVENTION

It is an object of the present invention to provide an improved carburetor designed to provide greater fuel efficiency.

According to the present invention, there is provided a carburetor which has a main air passageway extending between an air inlet and an air outlet and having a narrower venturi portion intermediate the air inlet and air outlet. A throttle valve is located near the air outlet and a second narrower passageway extends substantially parallel to the main air passageway. The second narrower passageway has an air inlet from the main air passageway with a fuel inlet thereto which is downstream from the air inlet, and a first outlet from the second passageway to the main air passageway proximate the venturi portion. There is also provided a second outlet from the second passageway intermediate the venturi portion and the maximum extent of the throttle valve towards the venturi portion. The main air passageway has an abruptly expanded wall portion at one side of the downstream end of the venturi portion.

DETAILED DESCRIPTION OF THE DRAWINGS

Figure 1:
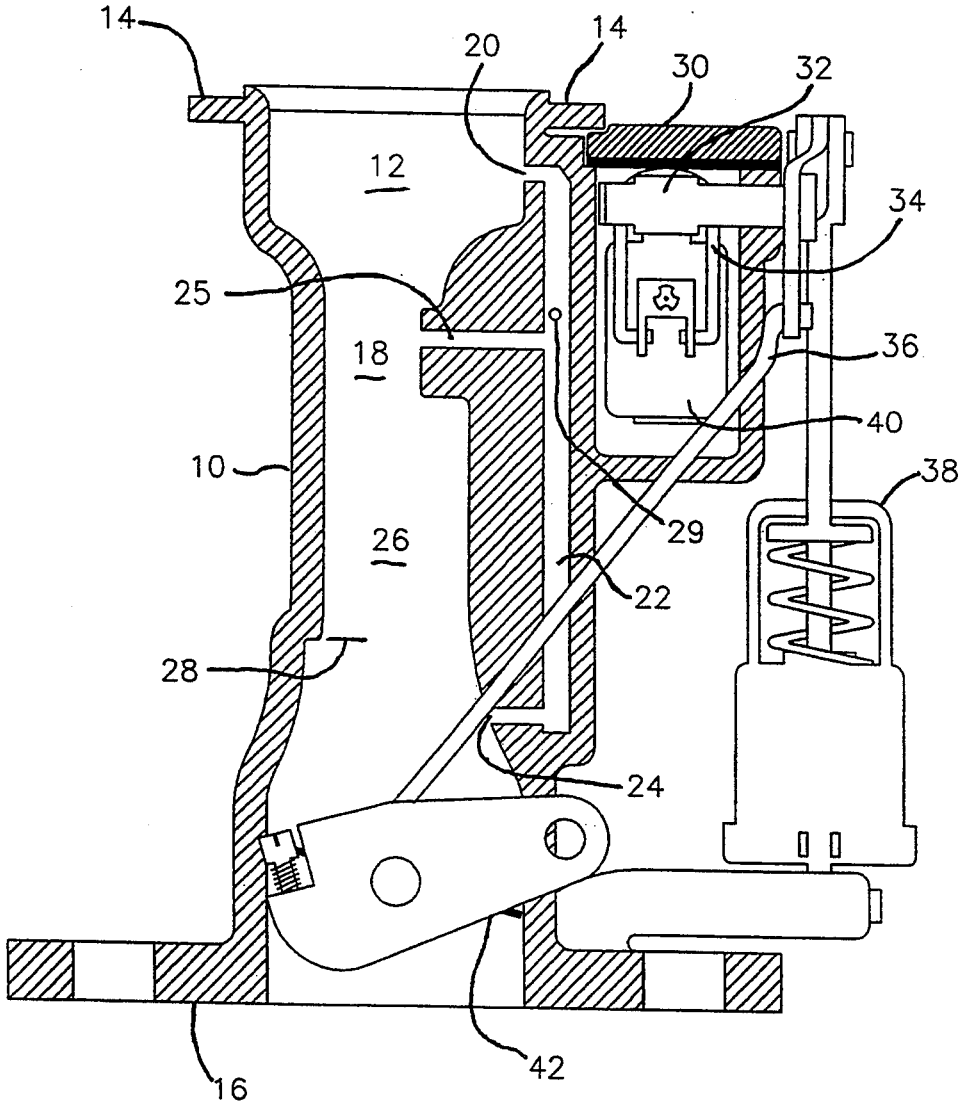
FIG. 1 is a side sectional view of a carburetor according to the present invention.

Referring to the drawings there is illustrated a carburetor incorporating the improvement of the present invention. The carburetor wall 10 terminates at the top in an annular flange 14 adapted to receive an air filter and at the bottom wall 10 terminates in a base 16. An air inlet 12 is defined at the top while, as may be seen from FIG. 1, the wall portion extends inwardly to define a first venturi section 18 having a relatively small diameter and a second venturi section 26 having a somewhat larger diameter. An abruptly expanded wall portion 28 extends inwardly near the bottom portion of venturi section 26.

Extending parallel to venturi sections 18 and 26 is a narrower passageway generally designated by reference numeral 22 and having an inlet 20 thereto proximate air inlet 12. A first outlet 25 extends from narrower passageway 22 into venturi section 18 below fuel inlet 29 while a second outlet 24 extends below venturi section 26 and expanded portion 28.

A conventional fuel bowl section generally designated by reference numeral 32 includes a float 40, float actuator 32, and a solenoid 38. A pivot 34 operates in a substantially conventional manner as a mixture enricher by depressing the float and in this respect, there is provided a throttle lever 42 which is connected to throttle depress rod 36.

It will be understood that the above described embodiment is for purposes of illustration only and changes and modifications may be made thereto without departing from the spirit and scope of the invention.

What is claimed is:

1. In a carburetor having a housing with a wall defining a main air passageway extending between an air inlet and an air outlet and having a narrower venturi portion intermediate said air inlet and said air outlet, and a throttle valve proximate said air outlet, the improvement wherein the carburetor has a second narrower passageway within said wall, said second passageway extending substantially parallel to said main air passageway, said second passageway communicating with and having an air inlet from said main air passageway proximate said air inlet of said main passageway, a fuel inlet to said second passageway downstream from said inlet, a first outlet from said second passageway to said main air passageway proximate said narrower venturi portion, and a second outlet from said second passageway intermediate said venturi portion and the maximum extent of said throttle valve toward said venturi portion said main air passageway having an abruptly expanded wall portion at one side of a downstream end of said venturi portion.

2. The carburetor of claim 1 further including mixture enricher means.

* * * * *